United States Patent [19]

Smith

[11] Patent Number: 4,707,574

[45] Date of Patent: Nov. 17, 1987

[54] DISCONNECT SWITCH WITH LATCH

[75] Inventor: Wayne A. Smith, Tucker, Ga.

[73] Assignee: Kearney-National, Inc., Atlanta, Ga.

[21] Appl. No.: 922,299

[22] Filed: Oct. 23, 1986

[51] Int. Cl.[4] ..... H01H 21/56

[52] U.S. Cl. ..... 200/48 KB; 200/325

[58] Field of Search ..... 200/48 KB, 325

[56] References Cited

U.S. PATENT DOCUMENTS

| | | | |
|---|---|---|---|
| 1,826,733 | 10/1931 | Christensen | 200/325 |
| 2,917,609 | 12/1959 | Mikos | 200/325 |
| 3,193,632 | 7/1965 | Sprague | 200/48 KB |

*Primary Examiner*—Henry J. Recla
*Assistant Examiner*—Renee S. Luebke
*Attorney, Agent, or Firm*—Rodgers & Rodgers

[57] ABSTRACT

An electric disconnect switch having fixed and movable contacts includes a latch mounted for limited oscillating and sliding movement on the movable contact and operable by a manual operating member, a ramp fixedly mounted on the fixed contact and having a latching surface engageable by the latch, a biasing device arranged to bias the latch in a direction to maintain the latch in engagement with the latching surface, together with a low friction device mounted on the movable contact and engageable with a part of the latch during a switch closing operation to impart closing movement to the movable contact in response to closing movement of the operating member.

6 Claims, 6 Drawing Figures

DISCONNECT SWITCH WITH LATCH

TECHNICAL FIELD

This invention relates to electric switches of the disconnect type and is particularly concerned with latching means for such switches.

BACKGROUND ART

U.S. Pat. No. 3,193,632 issued July 6, 1965 discloses a disconnect switch having a latching arrangement which due to the particular construction and arrangement of the latching mechanism is not well adapted to maintain the switch in closed condition during high current fault conditions.

DISCLOSURE OF THE INVENTION

According to this invention in one form, an electric disconnect switch having fixed and movable contacts is provided with a latch mounted on the movable contact and arranged for limited oscillating and sliding movement thereon together with a latch engaging ramp fixedly mounted on the fixed contact and having a latching surface engageable by the latch, biasing means arranged to bias the latch in a direction to maintain latch engagement with the latching surface thereby to insure that the switch remains closed during high current fault or overload conditions together with low friction means mounted on the movable contact and engageable with a part of the latch during a switch closing operation whereby switch closing movement is imparted to the movable contact in response to switch closing movement of a manually operated member such as a hook stick.

While the drawings show the switch in a generally horizontal position, it will be understood that disconnect switches of this type are sometimes mounted in a vertical orientation.

BEST MODE OF CARRYING OUT THE INVENTION

Figure 1:
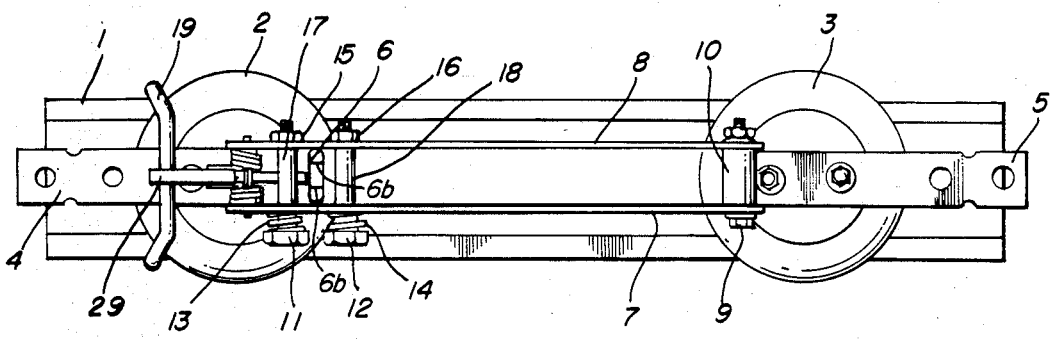
FIG. 1 is a plan view from above of a disconnect switch which embodies this invention.
Figure 2:
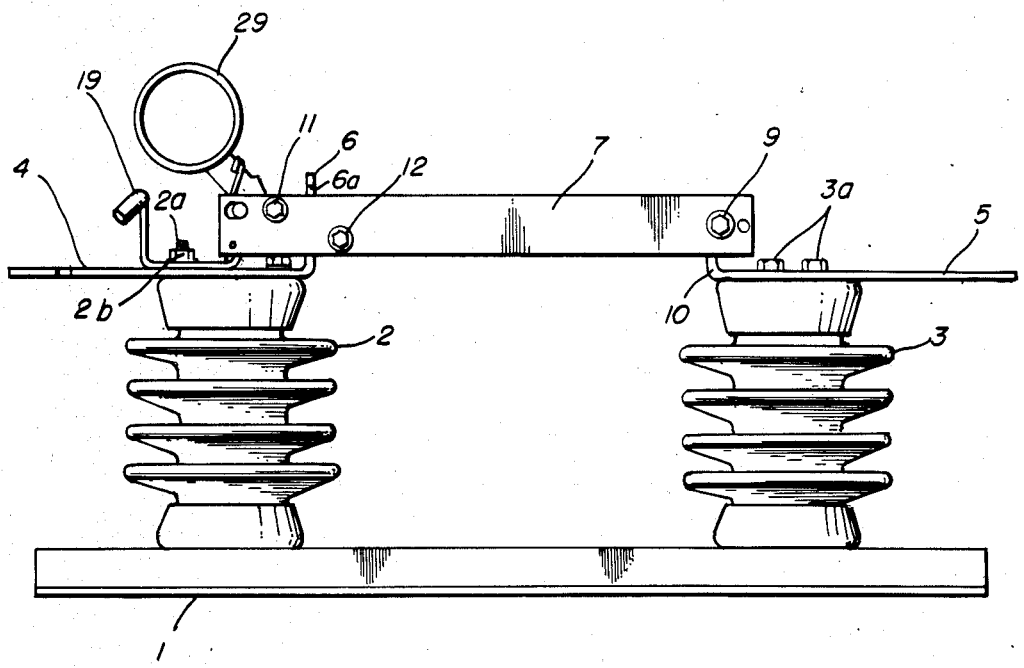
FIG. 2 is a side view of the switch shown in FIG. 1.
Figure 4:
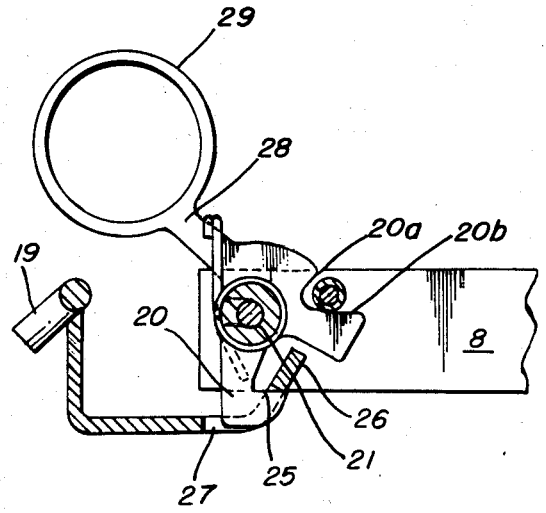
FIG. 4 is a cross sectional view of the latching mechanism formed according to this invention and which shows the latch in latched condition.

With particular reference to FIGS. 1 and 2 the numeral 1 designates a mounting base such as a metallic channel on which insulators 2 and 3 are securely mounted. A terminal 4 is mounted on insulator 2 while terminal 5 is mounted on insulator 3. Terminal 4 includes a portion 6 which constitutes a fixed contact of the switch.

The movable contact is in the form of a pair of parallel blades 7 and 8 which are pivotally mounted via the bolt 9 to a part 10 of terminal 5. A pair of bolts 11 and 12 interconnect the left hand ends of blades 7 and 8 and include compression springs 13 and 14 and nuts 15 and 16 respectively. A sleeve 17 is disposed about the bolt 11 while a sleeve 18 is disposed about the bolt 12.

The sleeves 17 and 18 serve to maintain switch blades 7 and 8 separated by a fixed distance when the switch is open. When the switch is closed, the tapered configuration of the fixed contact 6 is such that the bevelled corners of contact 6 extend from *6b* at the top of contact 6 to the point *6a* on the sides of the contact as shown in FIGS. 1 and 2 and when the switch is closed springs 13 and 14 are compressed somewhat and the ends of sleeves 17 and 18 are relieved of high pressure contact with the blades 7 and 8 and are then free to rotate about their respective bolts because of the low friction means so produced as compared to the friction between surfaces *20a* and *20b* which would exist in the absence of the force exerted on blades 7 and 8 by contact 6. If the sleeve 17 were omitted or were rigid and non rotatable, the resulting friction would impede easy operation of the mechanism. Rotation is facilitated due to the fact that blades 7 and 8 are urged away from high pressure contact with the ends of sleeve 17.

A hook contact 19 is secured to terminal 4 by bolt *2a* and its nut *2b* and constitutes a hook contact arranged to cooperate in known manner with a separate interrupter arranged to interrupt the flow of current during a switch opening operation.

Figure 3:
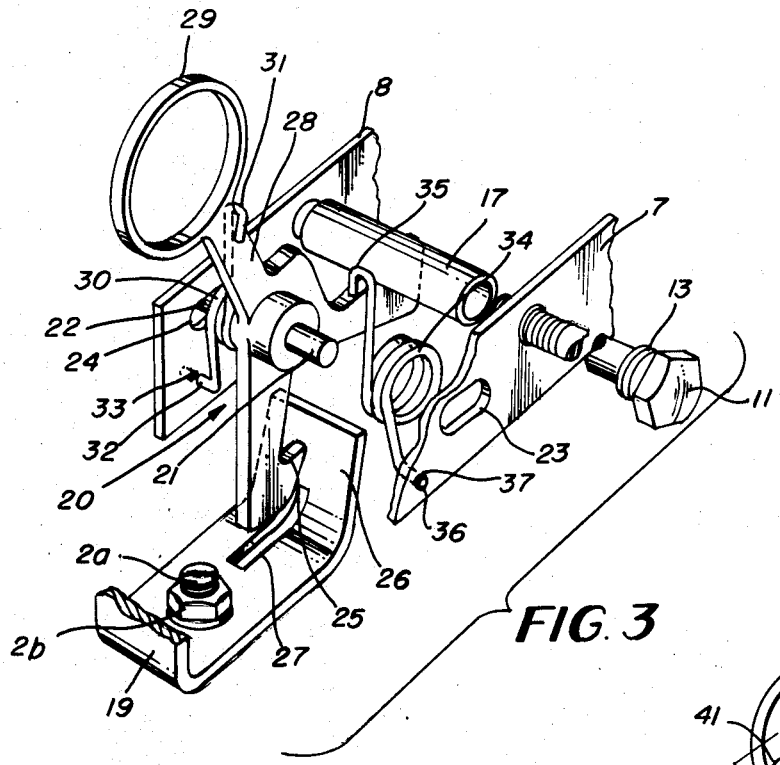
FIG. 3 is an enlarged partially exploded view of the latch and associated structure formed according to this invention.

The latching arrangement formed according to this invention is shown in detail in FIGS. 3–6. With reference particularly to FIG. 3, a latch 20 includes a pair of laterally extending bosses 21 and 22 which are mounted in slots 23 and 24 respectively for limited sliding and oscillating movement relative to the blades 7 and 8. The latch 20 includes a hook 25 which is arranged to slide along the fixed ramp 26 to engage the latching slot 27 formed in ramp 26 during a switch closing operation. The latch 20 also includes an operating arm 28 which includes a ring structure 29 for receiving a conventional operating means in the form of a manually operated hook stick. A helical spring 30 is arranged with one end 31 in enveloping relation to a part of the operating arm 28 and with its opposite laterally disposed end 32 mounted in an aperture 33 formed in switch blade 8. As viewed in FIG. 3, the helical spring 30 biases the latch in a generally counterclockwise direction about bosses 21 and 22. Disposed on the opposite side of the latch 20 is a helical spring 34 having an end 35 which is arranged to engage the operating arm 28 in a manner similar to the engagement of end 31 of helical spring 30. Helical spring 34 also has a laterally extending end portion 36 which is disposed within an opening 37 formed in switch blade 7. Spring 34 also biases latch 20 in a counterclockwise direction about bosses 21 and 22 as viewed in FIGS. 3–5.

Figure 6:
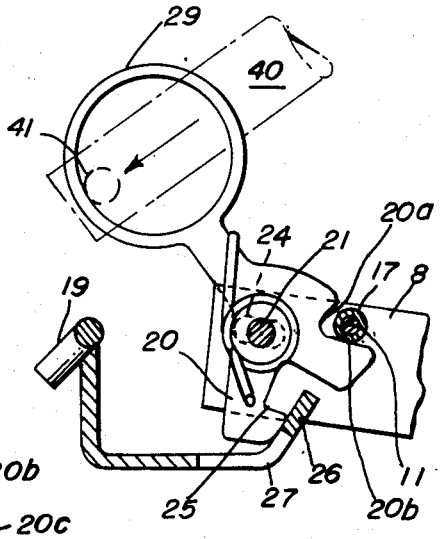

Assuming the switch is in open position, a closing operation is effected as represented in FIG. 6 by simply inserting the transverse element 41 of the hook stick 40 within the operating ring 29 and by imparting a force generally toward the left as viewed in FIG. 6. This action causes the latch 20 to swing to a position wherein the surfaces *20a* and *20b* of the latch 20 engage the sleeve 17 disposed about the bolt 11. Continued movement of the hook stick 40 swings the blades 7 and 8 about their pivot 9 into the position shown in FIG. 6. At this point, the latch 25 is moving along the inclined ramp 26 and the bosses 21 and 22 of the latch 20 are moved from the right hand ends of the slots 23 and 24 toward the left hand ends of those slots. This action is facilitated by the fact that the sleeve 17 about the bolt 11 constitutes low friction means whereby engagement of the surface 20*b* of the latch 20 with low friction sleeve 17 facilitates movement of the latch toward the left due to the sliding movement of the latch 20 along the ramp 26. The fact that the blades 7 and 8 are moved slightly apart from the positions which they occupy when the switch is open due to the tapered configuration of the fixed contact 6 relieves the sleeve 17 from frictional pressure along the ends of the sleeve 17 and the inner surfaces of the blades 7 and 8 by compressing spring 13. Continued movement of the parts from the positions represented in FIG. 6 to those shown in FIG. 4 results in latching of the latch surface 25 within the slot 27 formed in the ramp 26.

Disconnect switches are frequently called upon to conduct currents of substantial magnitude under fault or severe overload conditions. Such currents may tend to force the switch blades 7 and 8 out of contact with the fixed contact such as 6. According to a feature of this invention, the switch is securely maintained in closed condition even under current conditions of large magnitudes due to the action of springs 30 and 34 which continually bias the latch in a counterclockwise direction as viewed in FIGS. 3–6.

Figure 5:
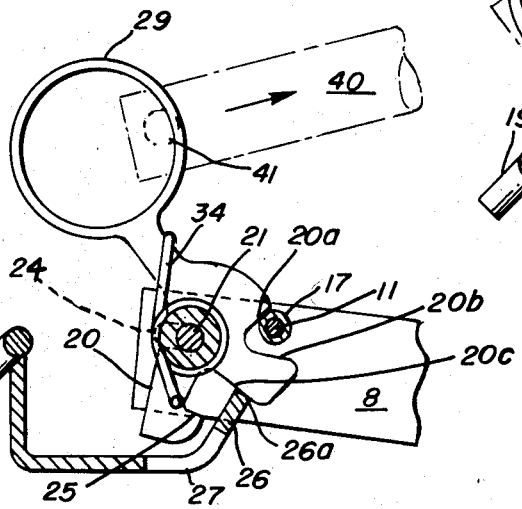
FIG. 5 is a view similar to FIG. 4 but which shows the parts during a switch opening operation and FIG. 6 is a view similar to FIGS. 4 and 5 which shows the parts during a switch closing operation.

In order to open the switch, a force is imparted generally toward the right as shown in FIG. 5 by the hook stick 40 which tends to rotate the latch 20 in a clockwise direction about the bosses 21 and 22. This action causes the surface 20*c* of the latch 20 to pry against the edge 26*a* of the ramp 26 and thus initiates opening of the switch blades 7 and 8 as represented in FIG. 5. Once the hook 25 has cleared the slot 27, the blades 7 and 8 are swung in a clockwise direction about their pivot 9 to their fully opened positions during which time the bosses such as 21 and 22 occupy the right hand ends of the slots 23 and 24 with the part 20*a* of the latch in engagement with low friction sleeve 17 as represented in FIG. 5.

INDUSTRIAL APPLICABILITY

By this invention, an improved latching mechanism is provided for heavy duty disconnect switches which securely maintains the switches closed even under extremely adverse current conditions and thus eliminates undesired pitting of the contacts due to arcing which may occur if the switch is not securely latched in closed position during the flow of currents of large magnitude.

I claim:

1. An electric disconnect switch comprising a fixed contact, a movable contact arranged to engage and to disengage said fixed contact, a latch mounted for limited oscillating and sliding movement on said movable contact and having a part engageable and disengageable with an operating member, a latch engaging ramp fixedly mounted on said fixed contact and having a slot including a latching surface at one end of said slot and engageable by said latch, biasing means arranged to bias rotation of said latch in a direction to maintain said latch in engagement with said ramp and with said latching surface, and low friction means mounted on said movable contact and engageable with a part of said latch during a switch closing operation to facilitate sliding movement of said latch relative to said movable contact whereby switch closing movement is imparted to said moveable contact in response to switch closing movement of said operating member.

2. A switch according to claim 1 wherein said latch includes a prying surface engageable with a part of said ramp for facilitating opening of the switch in coordination with rotating movement of said latch relative to said movable contact in response to switch opening movement of said operating member.

3. A switch according to claim 1 wherein a magnitude of friction of said low friction means is reduced from a magnitude of friction when the switch is open in coordination with contact between said fixed and said movable contacts during a switch closing operation.

4. A switch according to claim 1 wherein said movable contact comprises a pivotally mounted blade having a slot therein and wherein said latch includes a boss disposed in said slot.

5. A switch according to claim 4 wherein said slot is arranged in substantial alignment with said blade.

6. A switch according to claim 4 wherein sliding movement of said latch along said ramp during a switch closing operation imparts relative rotary movement to said boss and said slot.

* * * * *